US010040622B2

(12) United States Patent
Dellinger et al.

(10) Patent No.: US 10,040,622 B2
(45) Date of Patent: Aug. 7, 2018

(54) AEROSOL VALVE

(71) Applicant: Exal Corporation, Youngstown, OH (US)

(72) Inventors: Shawn William Dellinger, Youngstown, OH (US); Jeffrey Silver Taggart, Youngstown, OH (US); Nicholas E. Stanca, Youngstown, OH (US)

(73) Assignee: Exal Corporation, Youngstown, OH (US)

( * ) Notice: Subject to any disclaimer, the term of this patent is extended or adjusted under 35 U.S.C. 154(b) by 0 days.

(21) Appl. No.: 15/366,589

(22) Filed: Dec. 1, 2016

(65) Prior Publication Data

US 2017/0152099 A1 Jun. 1, 2017

Related U.S. Application Data

(60) Provisional application No. 62/261,388, filed on Dec. 1, 2015.

(51) Int. Cl.
*B65D 83/48* (2006.01)

(52) U.S. Cl.
CPC ..... *B65D 83/48* (2013.01)

(58) Field of Classification Search
CPC ..... B65D 83/48; B65D 83/46
(Continued)

(56) References Cited

U.S. PATENT DOCUMENTS 4,824,075 A * 4/1989 Holzboog ..... B65D 83/46 222/402.22
7,832,597 B2 * 11/2010 Scheindel ..... B65D 83/48 222/399

(Continued)

*Primary Examiner* — Lien Ngo
(74) *Attorney, Agent, or Firm* — Paul D. Banjor, Jr., Esquire

(57) ABSTRACT

An aerosol valve movable from a closed position to an open position for retaining a product in, and spraying the product from, a container, comprising: a valve cup positioned on a first end of the container that orients the aerosol valve in the container, wherein the valve cup has a lip that defines a valve cup opening into the container; a valve stem disposed in the valve cup opening so that a first portion of the valve stem is disposed above the lip and a second portion of the valve stem is disposed below the lip within the container, the valve stem having an open first end, a closed second end and defining a longitudinal passageway therebetween with the open first end defining an outlet from the passageway of the valve stem, a side of the valve stem defining at least one inlet into the passageway near the closed second end; a resilient seal disposed in the valve cup opening between the valve stem and the lip, wherein the resilient seal comprises a seal body having a first portion disposed above the lip and a second portion disposed below the lip within the container, the seal body defining a seal body bore which the valve stem is disposed in and partially through; a ring knife disposed around the second closed end of the valve stem between the valve stem and the resilient seal, wherein the ring knife defines at least one arcuate shaped knife configured to mate with an outer surface of the valve stem and close the at least one inlet of the valve stem in a closed position of the aerosol valve; wherein force on the valve stem in a directions towards the container at least partially compresses the resilient seal and moves the at least one inlet past the arcuate shaped knife to allow product under pressure within the container to enter the inlet and travel through the longitu- (Continued)

dinal passageway and out through the outlet; and wherein upon release of the force on the valve stem, the resilient seal forces the valve stem back to the closed position wherein the arcuate shaped knife covers the at least one inlet of the valve stem.

8 Claims, 10 Drawing Sheets

(58) Field of Classification Search
USPC ..... 222/21, 402.21–402.24, 512, 513, 402.1
See application file for complete search history.

(56) References Cited

U.S. PATENT DOCUMENTS 8,418,996 B2 * 4/2013 Rideg ..... B05B 11/3077 222/402.1
8,905,273 B2 * 12/2014 de Schrijver ..... B65D 83/201 222/402.1

* cited by examiner

AEROSOL VALVE

CROSS REFERENCE TO RELATED APPLICATIONS

This application claims the benefit of the filing date of U.S. provisional patent application Ser. No. 62/261,388, filed on Dec. 1, 2015, the entirety of which is incorporated herein by reference for all purposes.

BACKGROUND

The present disclosure is directed to a valve assembly for a dispensing container for viscous and liquid products having high-solids entrained therein maintained under pressure in the container. A typical pressurized dispensing container includes a nozzle and a valve assembly operably associated with the nozzle. The product to be dispensed through the nozzle is pumped through a passageway of the valve assembly and an outlet opening of the nozzle. The valve assembly generally includes a valve mechanism which reciprocates a valve stem in the container to open and close the outlet opening. However, the high solids entrained in the product may become trapped between the valve stem and the interior surface of the passageway and/or the interior surface of the outlet opening when the valve stem is moved to close off the nozzle. These trapped solids can prevent the valve stem from properly closing thereby preventing the formation of a tight seal between the valve stem and the outlet opening walls of the nozzle.

SUMMARY

One aspect of a preferred embodiment of the present disclosure comprises an aerosol valve movable from a closed position to an open position for retaining a product in, and spraying the product from, a container, comprising: a valve cup positioned on a first end of the container that orients the aerosol valve in the container, wherein the valve cup has a lip that defines a valve cup opening into the container; a valve stem disposed in the valve cup opening so that a first portion of the valve stem is disposed above the lip and a second portion of the valve stem is disposed below the lip within the container, the valve stem having an open first end, a closed second end and defining a longitudinal passageway therebetween with the open first end defining an outlet from the passageway of the valve stem, a side of the valve stem defining at least one inlet into the passageway near the closed second end; a resilient seal disposed in the valve cup opening between the valve stem and the lip, wherein the resilient seal comprises a seal body having a first portion disposed above the lip and a second portion disposed below the lip within the container, the seal body defining a seal body bore which the valve stem is disposed in and partially through; a ring knife disposed around the second closed end of the valve stem between the valve stem and the resilient seal, wherein the ring knife defines at least one arcuate shaped knife configured to mate with an outer surface of the valve stem and close the at least one inlet of the valve stem in a closed position of the aerosol valve; wherein force on the valve stem in a directions towards the container at least partially compresses the resilient seal and moves the at least one inlet past the arcuate shaped knife to allow product under pressure within the container to enter the inlet and travel through the longitudinal passageway and out through the outlet; and wherein upon release of the force on the valve stem, the resilient seal forces the valve stem back to the closed position wherein the arcuate shaped knife covers the at least one inlet of the valve stem.

In another aspect of a preferred aerosol valve of the present disclosure, the valve stem defines a pair of diametrically spaced inlets into the passageway near the closed second end and wherein the ring knife defines a pair of arcuate shaped knifes; each of the knifes configured to mate with an outer surface of the valve stem and close one of the inlets of the valve stem in a closed position of the aerosol valve.

In yet another aspect of a preferred aerosol valve of the present disclosure, the valve stem defines a radially extending flange having an engaging surface that engages with the resilient seal.

In another aspect of a preferred aerosol valve of the present disclosure, the valve stem defines a circumferential groove located below the flange.

In a further aspect of a preferred aerosol valve of the present disclosure, the first portion of resilient seal defines an inwardly extending annular tab which is received in the circumferential groove of the valve stem in the closed position of the aerosol valve.

In another aspect of a preferred aerosol valve of the present disclosure, the side of the valve stem near the closed end and axially inwards towards the container defines an outwardly flared section engaged by the ring knife in the closed position of the aerosol valve.

In yet another aspect of a preferred aerosol valve of the present disclosure, the flared section defines at least one cutout section to allow the flared section to be at least partially compressed inwardly by the ring knife.

In another aspect of a preferred aerosol valve of the present disclosure, an inner surface of the seal body defines a first circumferential recess axially spaced from the inwardly extending annular tab wherein the first circumferential recess allows the first portion of the seal body to at least partially compress via engagement with the radially extending flange of the valve stem as the valve stem is moved from the closed position to the open position.

In an additional aspect of a preferred aerosol valve of the present disclosure, the inner surface of the seal body defines an annular first wiper that wipes an outer surface of the valve stem and an annular second wiper axially spaced the first wiper that wipes an outer surface of the ring knife.

In another aspect of a preferred aerosol valve of the present disclosure, the inner surface of the seal body defines a second circumferential recess axially spaced from the first circumferential recess.

In yet another aspect of a preferred aerosol valve of the present disclosure, the ring knife defines an outwardly extending first annular ledge that is disposed in the second circumferential recess in the inner surface of the seal body.

In another aspect of a preferred aerosol valve of the present disclosure, the seal body defines an outwardly extending flange having an engaging surface for engaging the lip.

In a further aspect of a preferred aerosol valve of the present disclosure, the second portion of the seal body is enlarged compared to the first portion of the seal body and the second portion of the seal body defines a second annular ledge and wherein the lip is positioned between the outwardly extending flange and the second annular ledge.

In another aspect of a preferred aerosol valve of the present disclosure, the ring knife comprises ring knife body having upper and lower end portions with the first annular ledge positioned between the upper and lower end portions, and wherein the ring knife body defines a ring knife body bore extending axially through the ring knife body, and an inner surface of the ring knife body defines a pair of circumferentially spaced guide channels.

In an additional aspect of a preferred aerosol valve of the present disclosure, each guide channel is adapted to receive a corresponding axial guide tab disposed the second portion of the valve stem to guide movement of the valve stem during actuation of the aerosol valve.

A valve assembly for use with a high pressure piston-type dispensing container comprises a valve stem, a seal and a ring knife. The seal is received in a valve cap of the container. The valve stem is movable within a bore of the seal as the valve assembly is moved between a closed position and an opened position. The ring knife is secured in the bore of the seal and is fitted over an end portion of the valve stem. The ring knife is fixed in position relative to the movable valve stem. The end portion of the valve stem includes at least one orifice through which product within the container flows into a passageway of the valve stem. The ring knife includes at least one knife edge which closes the at least one orifice in the closed position of the valve assembly. The at least one knife edge is further adapted to scrape and cut away any high solids entrained in the product trapped in the at least one orifice which can prevent the valve assembly from closing. In the closed position of the valve assembly, an end portion of the ring knife is seated on an outwardly flared section of the valve stem.

DETAILED DESCRIPTION

It should, of course, be understood that the description and drawings herein are merely illustrative and that various modifications and changes can be made in the structures disclosed without departing from the present disclosure. It will also be appreciated that the various identified components of the exemplary valve assembly disclosed herein are merely terms of art that may vary from one manufacturer to another and should not be deemed to limit the present disclosure.

Figure 1:
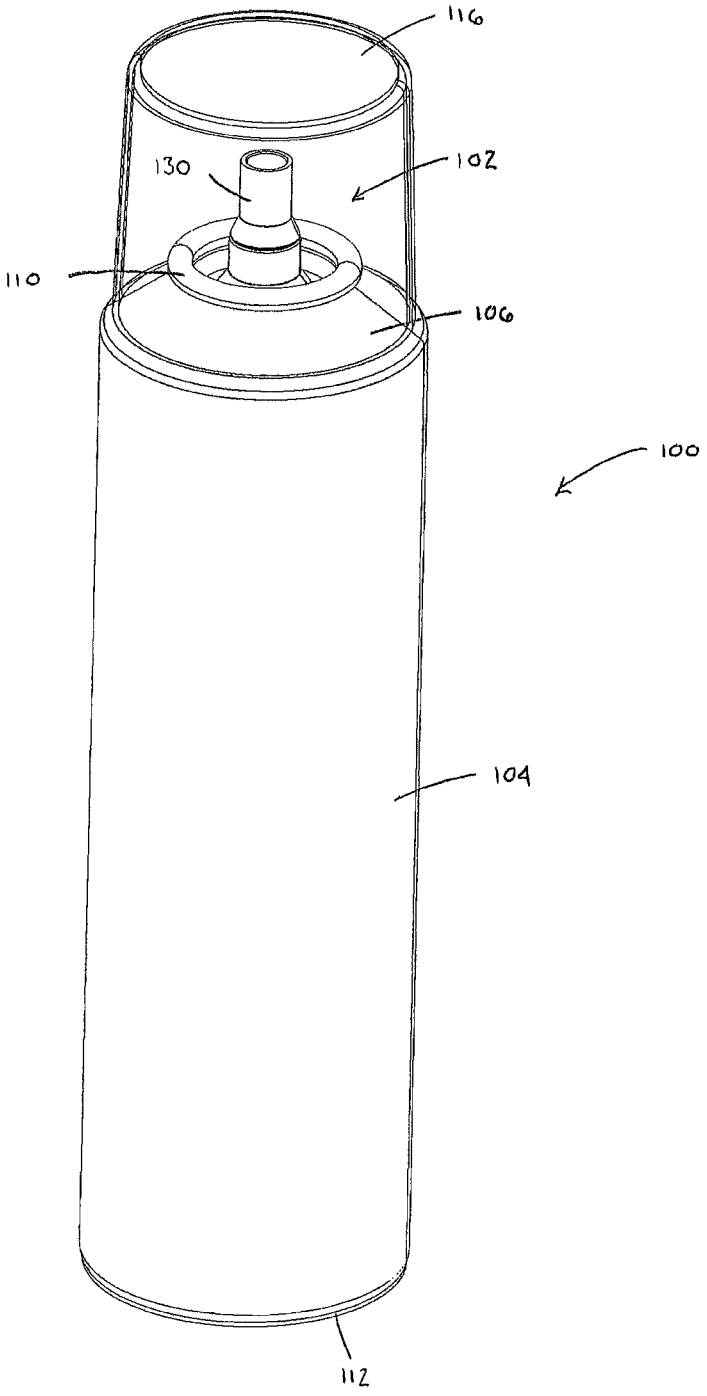
FIG. 1 is a perspective view of a high pressure piston-type dispensing container including a valve assembly according to the present disclosure.
Figure 2:
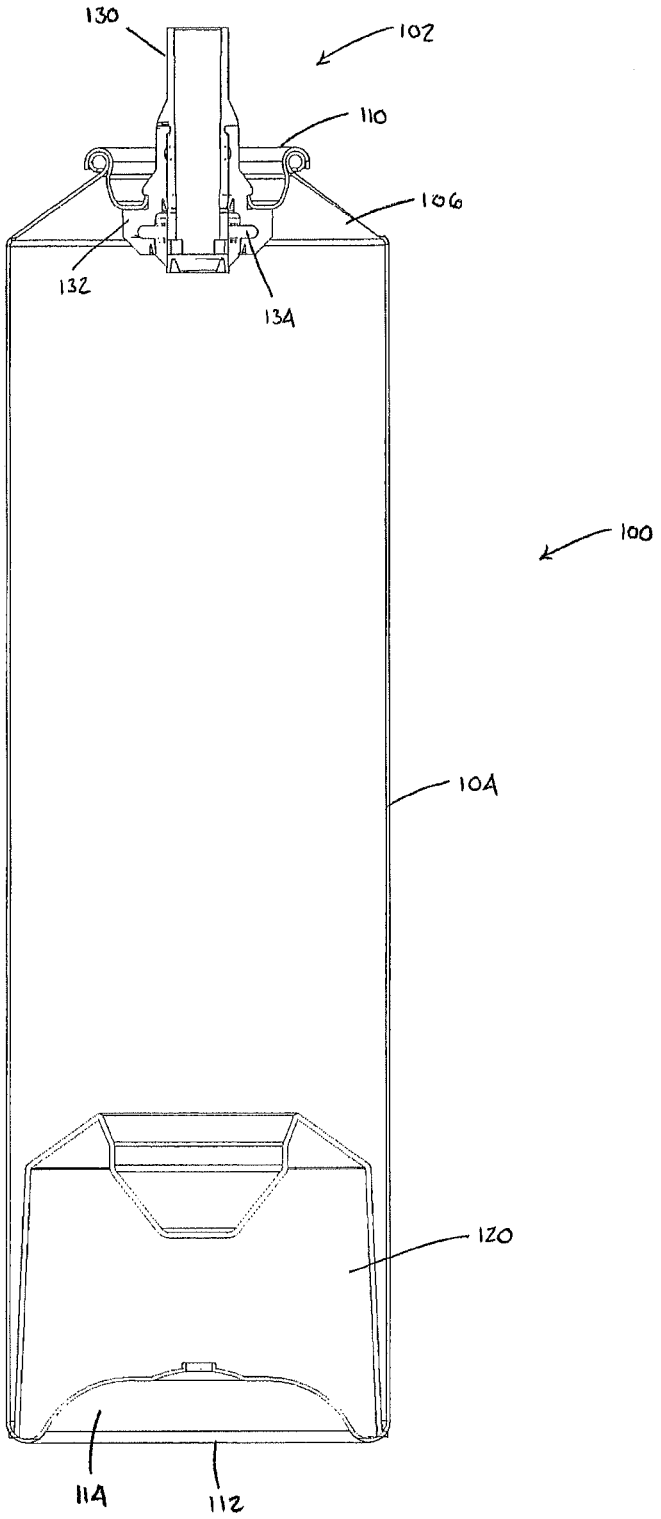
FIG. 2 is a cross-sectional view of the container of FIG. 1.

Referring now to the drawings, wherein like numerals refer to like parts throughout the several views, FIGS. 1 and 2 illustrate a high pressure piston-type dispensing container 100 adapted to be used with viscous and liquid products having high-solids entrained therein. The product is maintained under pressure in the container 100 and is adapted to be dispensed from the container 100 by actuation of an exemplary valve assembly 102 by the consumer. The container 100 includes an elongated cylinder 104 having at its upper end a neck portion 106 to which is secured in a known manner a valve cup 110. A lower end of the container 100 is closed by a bottom wall 112. A nozzle (not shown) can be operably connected to the valve assembly 102 and a lid 116 releasably connected to the upper end of the container 100 covers the valve assembly 102. As is well known, housed within the container cylinder 104 is a piston 120. In a customary manner, actuation of the valve assembly 102 allows the product, which is contained inside cylinder 104 above piston 120, to be pushed upwardly thereby due to pressure in an area 114 beneath the piston 120, and consequently dispensed from the valve assembly 102 and through the nozzle.

With reference to FIGS. 3-6, the valve cup 110 includes a central opening 124 at least partially defined by an upwardly curled lip 126 and has set in the central opening 124 the exemplary valve assembly 102. The valve assembly 102 generally includes a valve stem 130, a seal 132, and a ring knife 134. The valve stem 130 includes an upper end portion 140, an opposite lower end portion 142, and defines a central passageway 144 extending axially between the upper and lower end portions 140, 142. The central passageway 144 is in communication with an outlet of the nozzle. A radially extending flange 148 having an engaging surface 150 is provided on the upper end portion 140 of the valve stem 130 and located below the flange 148 is a circumferential groove 154. The lower end portion 142 of the valve stem 130 includes at least one orifice 156 through which the product under pressure moves though into the central passageway 144. In the depicted embodiment, a pair of diametrically spaced orifices 156 is located on the lower end portion 142. Further provided at the lower end portion 142 beneath the orifices 156 is an outwardly flared section 160, which is engaged by the ring knife 134 in a closed position of the valve assembly 102 to effectively close off the orifices 156. It should be appreciated that the flared section 160 can be provided with cutouts 162 which allow the flared section 160 to be at least partially compressed inwardly by the ring knife 134 thereby forming a tight seal between the valve stem 130 and the ring knife 134.

The seal 132 includes a body 166 having a first end portion 168 and a second end portion 170 opposite the first end portion. A bore 172 extends axially through the body 166 and is dimensioned to receive the valve stem 130. The first end portion 168 is provided with an inwardly extending annular tab 176 which is received in the groove 154 of the valve stem 130 in the closed position of the valve assembly 102. An inner surface 180 of the seal body 166 (which defines the bore 172) includes a circumferential first recess 182 axially spaced downwardly (toward the second end portion 170) from the tab 176. The first recess 182 allows the first end portion 168 of the seal body 166 to at least partially compress (via engagement with the flange 148) as the valve assembly 102 is moved from the closed position to an opened position. Further provided on the inner surface 180 is an annular first wiper 186 and an annular second wiper 188 axially spaced downwardly from the first wiper 186. It should be appreciated that the first wiper 186 scrapes or wipes the outer surface of the valve stem 130 as the valve stem is moved within the bore 172, and the second wiper 188 scrapes or wipes an outer surface of the ring knife 134. As depicted, the second end portion 170 of the body 166 is adapted to receive the ring knife 134, such that the ring knife 134 is fixed in position relative to the valve stem 130. In other words, the ring knife does not move together with the valve stem within the seal 132. To allow for this arrangement, in the depicted embodiment the second end portion 170 is enlarged (i.e., extends radially outwardly) relative to the first end portion 168 such that a shoulder 190 is formed on the inner surface 180. The inner surface 180 at the second end portion 170 further includes a circumferential second recess 192 axially spaced downwardly from the shoulder 190. The ring knife 134 includes a body 194 having an outwardly extending annular ledge 196. The ring knife 134 is inserted into the seal bore 172 from the second end portion 170, the body 194 engages the shoulder 190 and the ledge 196 is received in the second recess 192.

Figure 3:
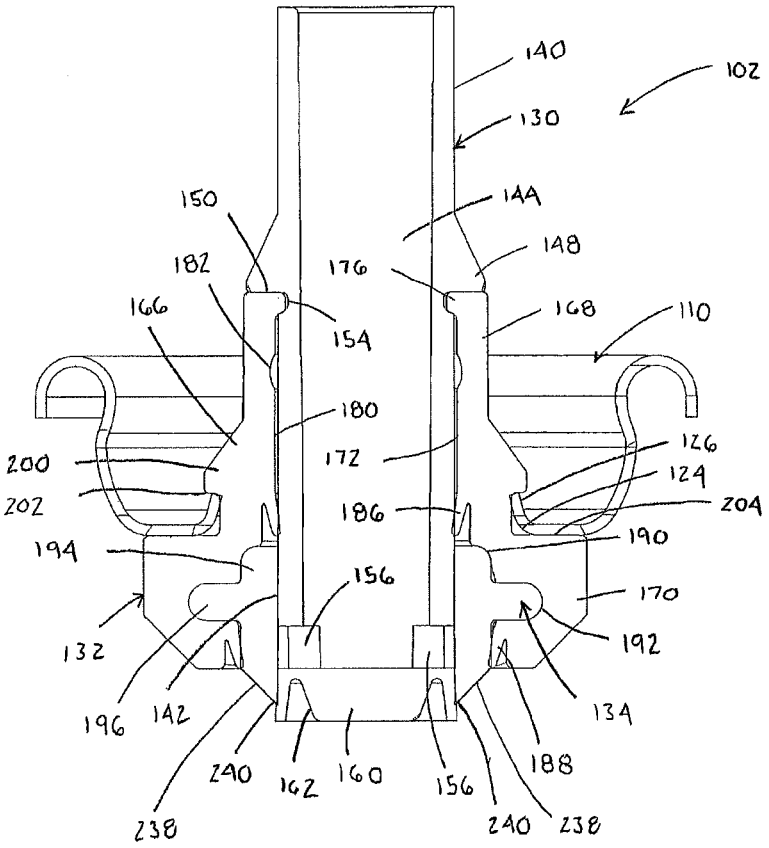
FIGS. 3 and 4 are cross-sectional views of the valve assembly of FIG. 1 in a closed position, FIG. 4 being rotated ninety degrees relative to FIG. 3.
Figure 4:
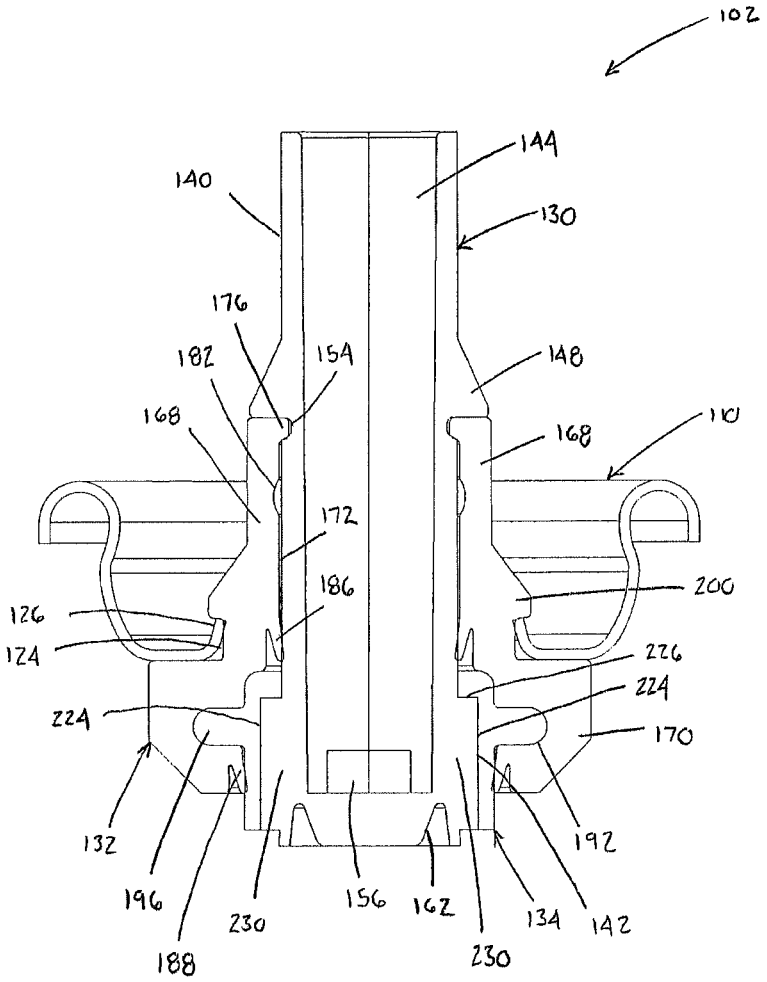
Figure 5:
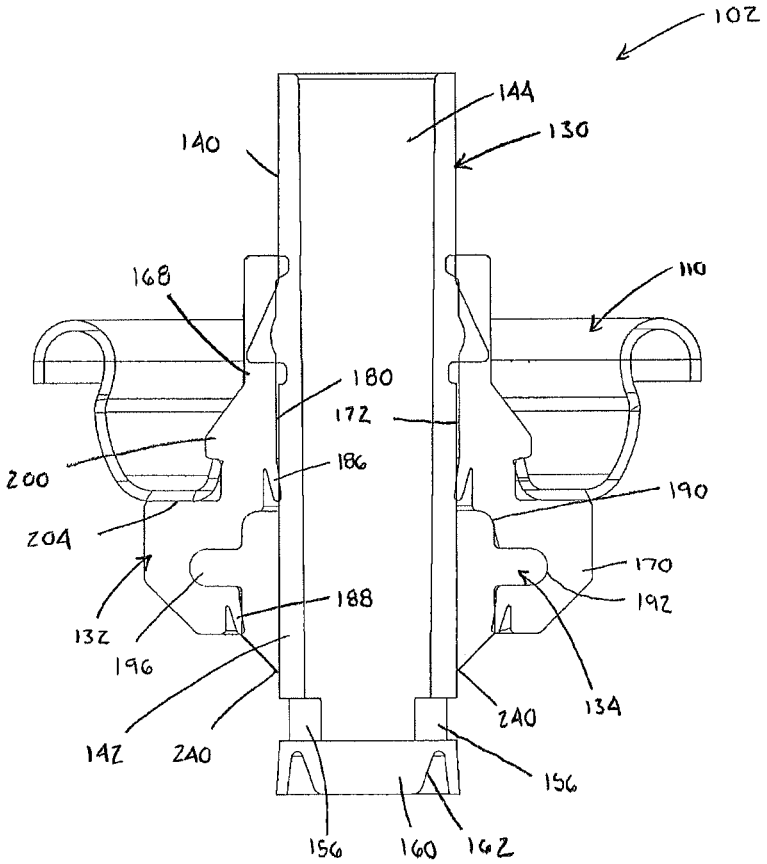
FIG. 5 is a cross-sectional view of the valve assembly of FIG. 1 in an opened position.
Figure 6:
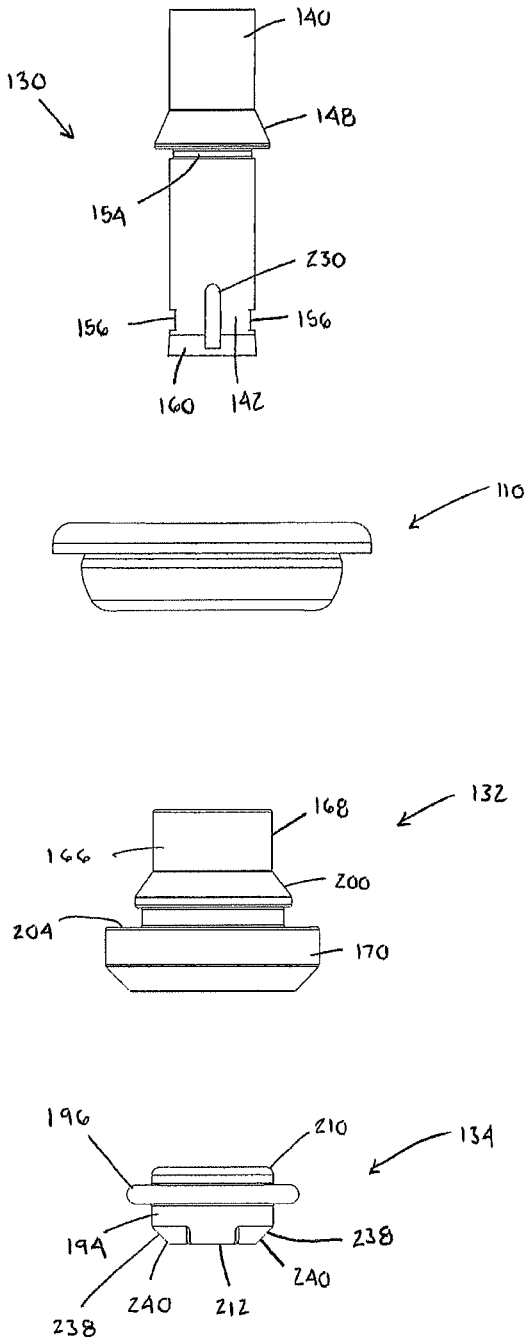
FIGS. 6 and 7 are exploded views of the valve assembly of FIG. 1, FIG. 7 being rotated ninety degrees relative to FIG. 6.
Figure 7:
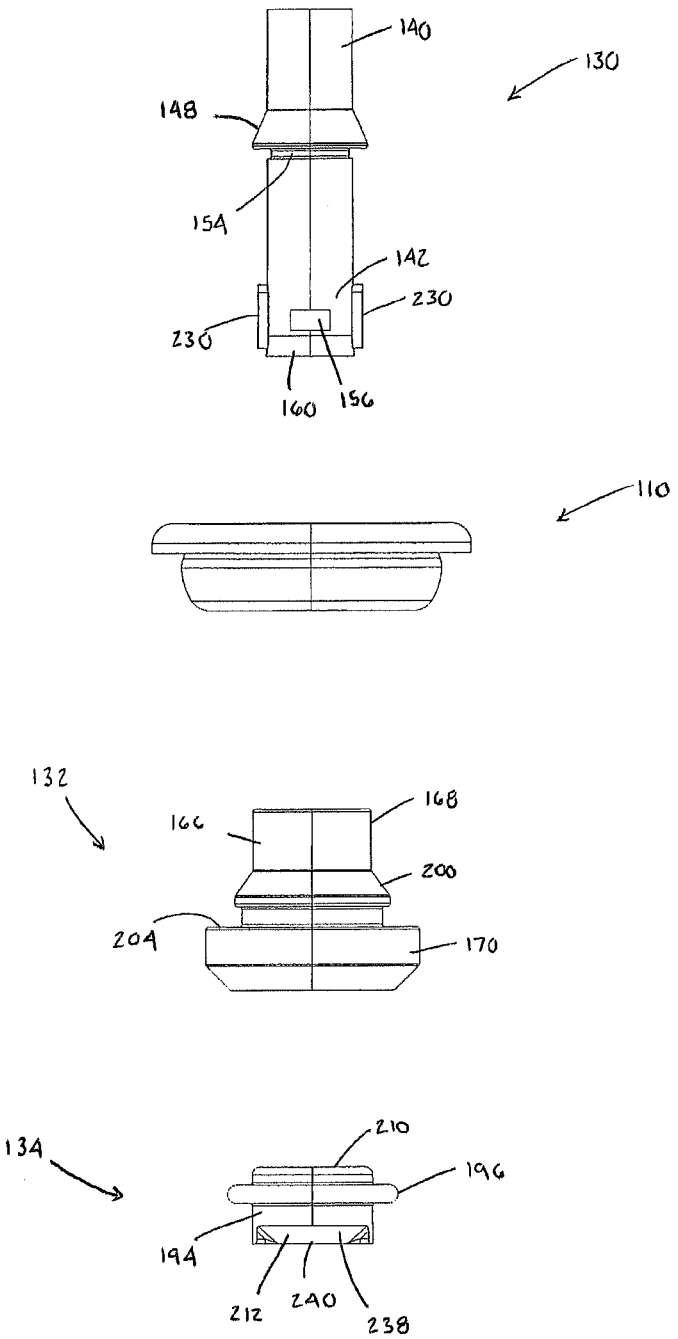
Figure 8:
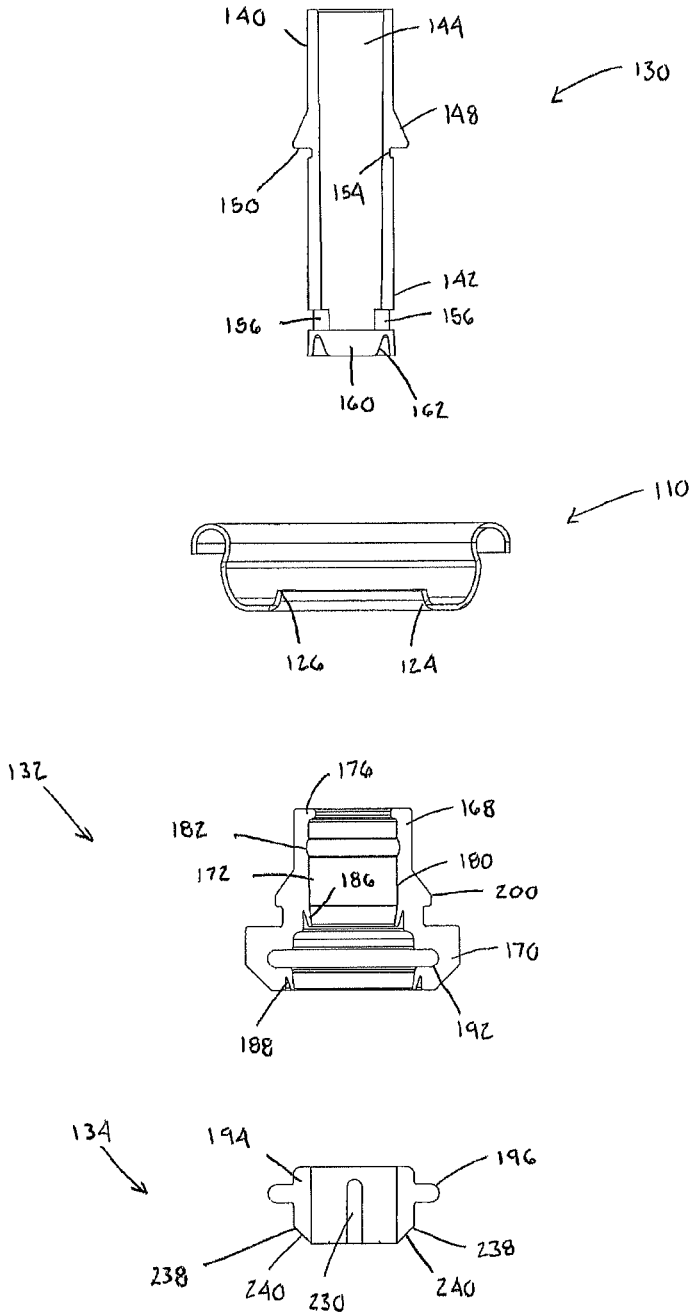
FIG. 8 is a cross-sectional view of the valve assembly of FIG. 6.

As best illustrated in FIGS. 3-5, located between the first and second end portions 168, 170 of the seal body 166 is a radially extending flange 200 having an engaging surface 202. An annular ledge 204 is defined by the enlarged second end portion 170. To releasably secure the seal 132 to the valve cap 110, the first end portion 168 of the seal body 166 is inserted through the central opening 124 of the valve cap 110 until the lip 126 is positioned between the flange 200 and the ledge 204.

Figure 9:
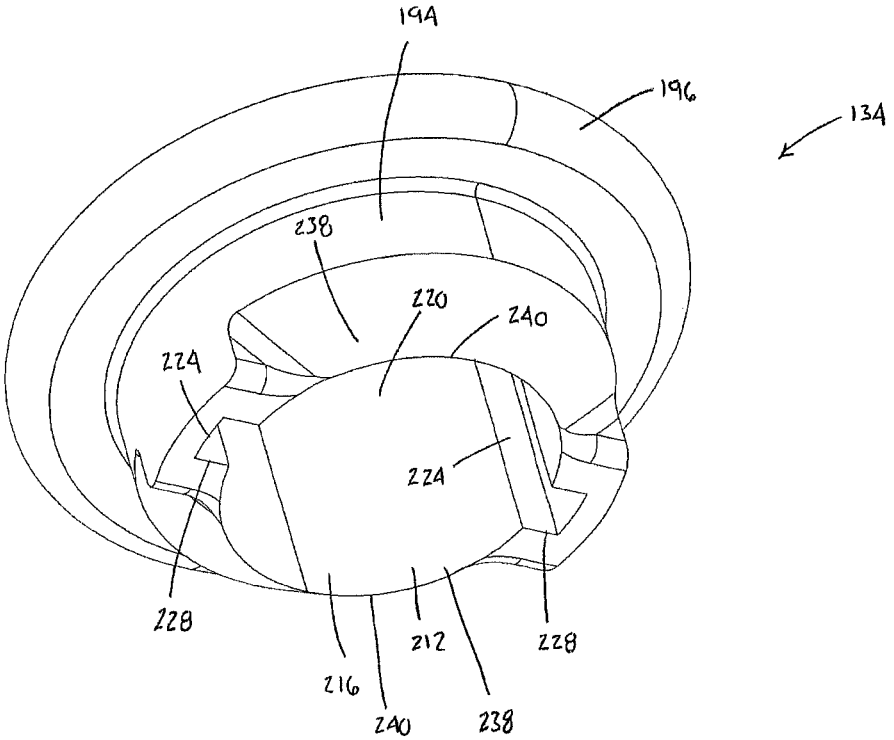
FIGS. 9 and 10 are perspective views of an exemplary ring knife of the valve assembly of FIG. 1.
Figure 10:
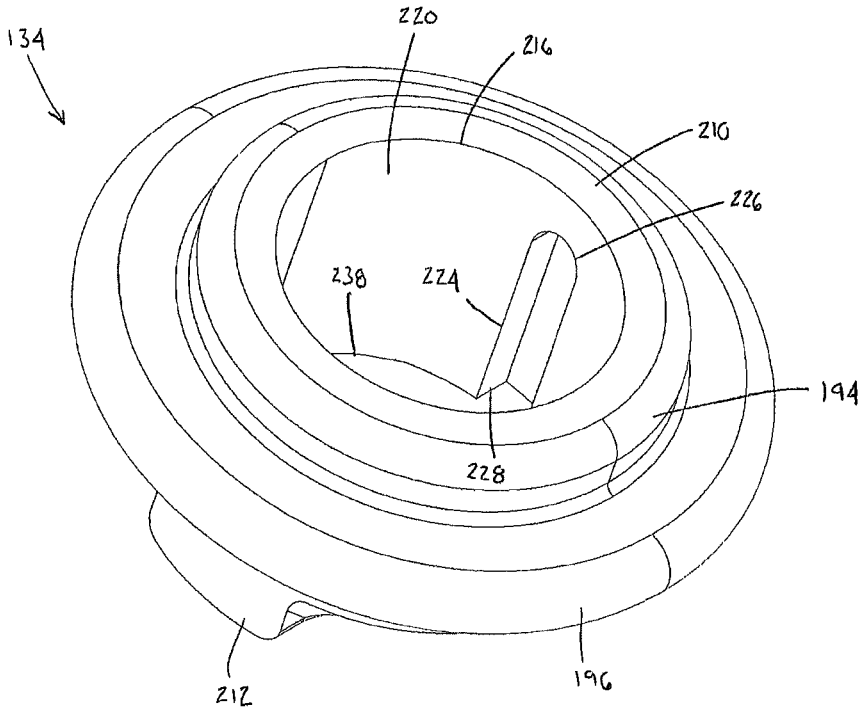

As best illustrated in FIGS. 9 and 10, the ring knife 134 includes the body 194 having upper and lower end portions 210, 212, with the annular ledge 196 positioned between the upper and lower end portions 210, 212. A bore 216 extends axially through the body 194, and an inner surface 220 of the body 194 (which defines the bore 216) includes at least one axial guide channel 224. In the depicted embodiment, a pair of circumferentially spaced guide channels 224 is formed on the inner surface 220. Each guide channel 224 includes a closed first end 226 and an open second end 228. The guide channels 224 are adapted to receive corresponding axial guide tabs 230 located on the lower end portion 142 of the valve stem 130 (see FIG. 4), and guide movement of the valve stem 130 during actuation of the valve assembly 102 by the consumer. It should be appreciated that the closed first ends 226 of the guide channels 224 can serve as stops for the valve stem 130 in the closed position of the valve assembly 102. The lower end portion 212 further defines a pair of arcuate shaped knifes 238 having edges 240 which extend between guide channels 224. The knifes 238 are configured to mate with the outer surface of the valve stem 130 and close the orifices 156 of the valve stem 130 in the closed position of the valve assembly. The knife edges 240 are configured to scrape the outer surface of the valve stem 130 and make a wiping cut of any high solids of the product being dispensed through the valve assembly 102 which may be trapped in the orifices 156 preventing the valve assembly 102 from moving to the closed position.

As is evident form the foregoing, the container valve assembly 102, shown in its closed position in FIGS. 3 and 4, is actuated when the valve stem 130 is depressed downwardly (via, for example, the nozzle) in a direction along the axis of the valve stem. With downward movement of valve stem 130, the outwardly flared section 160 at the lower end portion 142 moves away from the edges 240 of the ring knife 134 and the orifices 156 are open to the interior of the cylinder 104. Product under pressure within the cylinder 104 then moves through orifices 156 and outwardly through the central passageway 144 in the valve stem 130. As indicated previously, the downward movement of the valve stem 130 at least partially compresses the first end portion 168 of the seal 132. Upon release of the valve assembly 102, the resilient nature of the seal 132 causes the valve stem 130 to move upwardly, thereby closing the valve assembly 102 as the ring knife 134 seals against the outwardly flared section 160 thereby closing the orifices 156.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the present disclosure.

What is claimed is:

1. An aerosol valve movable from a closed position to an open position for retaining a product in, and spraying the product from, a container, comprising:

a valve cup positioned on a first end of the container that orients the aerosol valve in the container, wherein the valve cup has a lip that defines a valve cup opening into the container;

a valve stem disposed in the valve cup opening so that a first portion of the valve stem is disposed above the lip and a second portion of the valve stem is disposed below the lip within the container, the valve stem having an open first end, a closed second end and defining a longitudinal passageway therebetween with the open first end defining an outlet from the passageway of the valve stem, a side of the valve stem defining at least one inlet into the passageway near the closed second end;

a resilient seal disposed in the valve cup opening between the valve stem and the lip, wherein the resilient seal comprises a seal body having a first portion disposed above the lip and a second portion disposed below the lip within the container, the seal body defining a seal body bore which the valve stem is disposed in and partially through;

a ring knife disposed around the second closed end of the valve stem between the valve stem and the resilient seal, wherein the ring knife defines at least one arcuate shaped knife configured to mate with an outer surface of the valve stem and close the at least one inlet of the valve stem in a closed position of the aerosol valve;

wherein force on the valve stem in a directions towards the container at least partially compresses the resilient seal and moves the at least one inlet past the arcuate shaped knife to allow product under pressure within the container to enter the inlet and travel through the longitudinal passageway and out through the outlet;

wherein upon release of the force on the valve stem, the resilient seal forces the valve stem back to the closed position wherein the arcuate shaped knife covers the at least one inlet of the valve stem;

wherein the valve stem defines a pair of diametrically spaced inlets into the passageway near the closed second end and wherein the ring knife defines a pair of arcuate shaped knifes; each of the knifes configured to mate with an outer surface of the valve stem and close one of the inlets of the valve stem in a closed position of the aerosol valve;

wherein the valve stem defines a radially extending flange having an engaging surface that engages with the resilient seal;

wherein the valve stem defines a circumferential groove located below the flange;

wherein the first portion of resilient seal defines an inwardly extending annular tab which is received in the circumferential groove of the valve stem in the closed position of the aerosol valve;

wherein an inner surface of the seal body defines a first circumferential recess axially spaced from the inwardly extending annular tab wherein the first circumferential recess allows the first portion of the seal body to at least partially compress via engagement with the radially extending flange of the valve stem as the valve stem is moved from the closed position to the open position; and wherein the inner surface of the seal body defines an annular first wiper that wipes an outer surface of the valve stem and an annular second wiper axially spaced the first wiper that wipes an outer surface of the ring knife.

2. The aerosol valve of claim 1 wherein the side of the valve stem near the closed end and axially inwards towards the container defines an outwardly flared section engaged by the ring knife in the closed position of the aerosol valve.

3. The aerosol valve of claim 2 wherein the flared section defines at least one cutout section to allow the flared section to be at least partially compressed inwardly by the ring knife.

4. An aerosol valve movable from a closed position to an open position for retaining a product in, and spraying the product from, a container, comprising:

a valve cup positioned on a first end of the container that orients the aerosol valve in the container, wherein the valve cup has a lip that defines a valve cup opening into the container;

a valve stem disposed in the valve cup opening so that a first portion of the valve stem is disposed above the lip and a second portion of the valve stem is disposed below the lip within the container, the valve stem having an open first end, a closed second end and defining a longitudinal passageway therebetween with the open first end defining an outlet from the passageway of the valve stem, a side of the valve stem defining at least one inlet into the passageway near the closed second end;

a resilient seal disposed in the valve cup opening between the valve stem and the lip, wherein the resilient seal comprises a seal body having a first portion disposed above the lip and a second portion disposed below the lip within the container, the seal body defining a seal body bore which the valve stem is disposed in and partially through;

a ring knife disposed around the second closed end of the valve stem between the valve stem and the resilient seal, wherein the ring knife defines at least one arcuate shaped knife configured to mate with an outer surface of the valve stem and close the at least one inlet of the valve stem in a closed position of the aerosol valve;

wherein force on the valve stem in a directions towards the container at least partially compresses the resilient seal and moves the at least one inlet past the arcuate shaped knife to allow product under pressure within the container to enter the inlet and travel through the longitudinal passageway and out through the outlet;

wherein upon release of the force on the valve stem, the resilient seal forces the valve stem back to the closed position wherein the arcuate shaped knife covers the at least one inlet of the valve stem;

wherein the valve stem defines a pair of diametrically spaced inlets into the passageway near the closed second end and wherein the ring knife defines a pair of arcuate shaped knifes; each of the knifes configured to mate with an outer surface of the valve stem and close one of the inlets of the valve stem in a closed position of the aerosol valve;

wherein the valve stem defines a radially extending flange having an engaging surface that engages with the resilient seal;

wherein the valve stem defines a circumferential groove located below the flange;

wherein the first portion of resilient seal defines an inwardly extending annular tab which is received in the circumferential groove of the valve stem in the closed position of the aerosol valve;

wherein an inner surface of the seal body defines a first circumferential recess axially spaced from the inwardly extending annular tab wherein the first circumferential recess allows the first portion of the seal body to at least partially compress via engagement with the radially extending flange of the valve stem as the valve stem is moved from the closed position to the open position;

wherein the inner surface of the seal body defines a second circumferential recess axially spaced from the first circumferential recess; and wherein the ring knife defines an outwardly extending first annular ledge that is disposed in the second circumferential recess in the inner surface of the seal body.

5. The aerosol valve of claim 4 wherein the seal body defines an outwardly extending flange having an engaging surface for engaging the lip.

6. The aerosol valve of claim 5 wherein the second portion of the seal body is enlarged compared to the first portion of the seal body and the second portion of the seal body defines a second annular ledge and wherein the lip is positioned between the outwardly extending flange and the second annular ledge.

7. The aerosol valve of claim 6 wherein the ring knife comprises ring knife body having upper and lower end portions with the first annular ledge positioned between the upper and lower end portions, and wherein the ring knife body defines a ring knife body bore extending axially through the ring knife body, and an inner surface of the ring knife body defines a pair of circumferentially spaced guide channels.

8. The aerosol valve of claim 7 wherein each guide channel is adapted to receive a corresponding axial guide tab disposed the second portion of the valve stem to guide movement of the valve stem during actuation of the aerosol valve.

* * * * *